US005228464A

United States Patent [19]

Owens, Jr.

[11] Patent Number: 5,228,464

[45] Date of Patent: Jul. 20, 1993

[54] WRAPPER FOR SMOKING ARTICLE, SMOKING ARTICLE, AND METHOD OF MAKING SAME, CASE VIII

[75] Inventor: William F. Owens, Jr., Pisgah Forest, N.C.

[73] Assignee: P. H. Glatfelter Company, Spring Grove, Pa.

[21] Appl. No.: 871,481

[22] Filed: Apr. 21, 1992

Related U.S. Application Data

[63] Continuation-in-part of Ser. No. 656,497, Feb. 19, 1991, Pat. No. 5,107,864.

[51] Int. Cl.[5] ..... A24D 1/02

[52] U.S. Cl. ..... 131/365

[58] Field of Search ..... 131/365

[56] References Cited

U.S. PATENT DOCUMENTS

| | | | |
|---|---|---|---|
| 3,744,496 | 7/1973 | McCarty et al. | 131/8 |
| 5,131,416 | 7/1992 | Gentry | 131/365 |
| 5,159,944 | 11/1992 | Arzonieo et al. | 131/365 |

OTHER PUBLICATIONS

Leffingwell et al., *Tobacco Flavoring For Smoking Products,* 1972, pp. 6–7.

*Primary Examiner*—V. Millin
*Assistant Examiner*—J. Doyle
*Attorney, Agent, or Firm*—Kerkam, Stowell, Kondracki & Clarke

[57] ABSTRACT

A wrapper for a smoking article which, when wrapped about a tobacco column, provides improved mainstream smoke taste and sidestream smoke odor subjectives. These objectives are attained by forming a cellulosic sheet containing a small amount, but less than about 2%, of activated carbon having absorbed onto the carbon a volatile flavorant.

15 Claims, No Drawings

WRAPPER FOR SMOKING ARTICLE, SMOKING ARTICLE, AND METHOD OF MAKING SAME, CASE VIII

REFERENCE TO RELATED APPLICATIONS

This application is a continuation-in-part of application Ser. No. 07/656,497, filed Feb. 19, 1991, to issue as U.S. Pat. No. 5,107,864 on Apr. 28, 1992.

SUMMARY OF THE INVENTION

This invention provides a regular, reduced sidestream smoke or heavy weight cigarette paper or cigar wrapper which, when fabricated into a cigarette or cigar with a suitable tobacco column, statically burns at an acceptable rate, produces a light-colored, well-formed ash, which clings tightly without premature flaking and delivers both mainstream and sidestream smoke with a subjectively pleasant taste and aroma. More specifically, these desirable taste and aroma properties are achieved when certain defined levels of activated carbon, which contain certain levels of volatile flavors absorbed thereon, are incorporated into the sheet matrix of the cigarette paper or cigar wrapper or are applied to the surface (preferably on the inside-wire side-surface of the cigarette paper) which encloses the tobacco column. Flavors can be absorbed onto all or part of the carbon. Incorporation of the flavor-absorbed carbons into the sheet matrix to give desirable taste and aroma, as well as acceptable cigarette paper appearance, can be accomplished by maintaining a sheet carbon content of less than 2% carbon (preferably 1% or below) with the carbon particle size being such to totally pass through a 200 mesh screen (ASTM E-11 test) and preferably totally through 325 mesh screen.

The term, volatile flavorant, as used herein, pertains to a flavorant that volatilizes from the carbon at temperatures below the combustion temperature of the carbon, for example, at temperatures between about 50° C. and 300° C.

BACKGROUND OF THE INVENTION

Olin Corporation U.S. Pat. No. 3,744,496, discloses a carbon-filled paper to wrap cigarettes and/or cigars, preferably used as an inner liner with regular cigarette paper or cigar wrapper as an outer wrap. The paper described in U.S. Pat. No. 3,744,496 contains at least 5% carbon, thus making the appearance of the paper unacceptable for use as a white cigarette paper.

| PARAMETERS OF THE INVENTION | |
|---|---|
| Activated Carbon Content: | A small amount up to less than 2% |
| Preferred | 0.1% to 1.0% |
| Magnesium Hydroxide Content: | 0.0% to 35% |
| Preferred | 0.0% to 20% |
| Calcium Carbonate Content: | 5.0% to 40% |
| Preferred | 10% to 30% |
| Basis Weight: | 20 gm/m$^2$ to 100 gm/m$^2$ |
| Preferred | 25 gm/m$^2$ to 65 gm/m$^2$ |
| Porosity: | 1 to 200 Coresta |
| Preferred | 5 to 125 Coresta |
| Flavorants: | |
| Specific | Vanillin, ethyl vanillin, 3 methyl pentanoic acid, ethyl valerate, isoamyl isovalerate |
| General | Volatile, stable flavorants used in cigarette and cigar production |

-continued

| PARAMETERS OF THE INVENTION | |
|---|---|
| Burning Chemical: | Alkali metal salts of organic acids selected from the group consisting of citric, malic, lactic, glycolic, tartaric, fumaric, maleic, malonic, glutaric, adipic, acetic, and succinic |
| Burning Chemical Addition rate: | 0.5% to 6.0% |
| Acid Addition: | 0.0% to 10% organic or inorganic acid compatible with the alkali metal salt burning chemical |
| Sugar Addition: | 0.0% to 10% mono-, di-, tri-, or polysaccharides |
| Smoking Articles: | Cigarettes, cigars, and the like |

DESCRIPTION OF THE INVENTION

It has been found that by putting low levels (less than 2%) of finely pulverized activated carbon having volatile flavorants absorbed thereon into regular, reduced sidestream smoke or heavy weight cigarette papers or coated onto the surface of the cigarette paper, an enhancement in mainstream smoke taste and/or sidestream smoke aroma can be effected. With proper selection of both the carbon type and particle size, type flavorants and level of flavorant treatment of the carbon, cigarette and cigar products can be produced which have totally acceptable appearance (light gray-white for cigarettes and tan to brown for cigars), while possessing enhanced mainstream smoke taste and sidestream smoke aroma. The truly novel findings resulting from this invention are (1) the discovery that when certain particle sizes (very fine) of carbon incorporated at certain levels (below 2%) into cigarette type papers, totally acceptable appearance of cigarettes and cigars can be produced, and (2) at these levels of carbon(less than 2%), sufficient levels of certain volatile flavorants can be absorbed onto the carbon to effect significant enhancements of both mainstream smoke taste and sidestream smoke aroma as the cigarette/cigar product is smoked.

This development can be utilized with acid treatments of the carbon or total paper, as per Owens U.S. patent application Ser. No. 514,533, filed Apr. 26, 1990; Owens U.S. patent application Ser. No. 756,542, filed Sep. 9, 1991; Owens U.S. patent application Ser. No. 756,543, filed Sep. 9, 1991; and Owens U.S. patent application Ser. No. 756,544, filed Sep. 9, 1991; and with addition of sugars to give improved ash characteristics.

PREFERRED EMBODIMENTS

Typical results demonstrating the effects obtained in accordance with this invention are described in the following examples, which are illustrative of the invention only and are not in limitation thereof.

EXAMPLE I

Carbon Treatment

Two grams of ethyl vanillin dissolved in 2 grams of 95% ethyl alcohol were added to 8 grams of GX 248 activated carbon from North American Carbon, Inc. The mixture was well mixed and allowed to stand overnight before being used to prepare handsheets. Handsheets were prepared of regular type cigarette paper having the following properties: Basis weight of 25 gm/m$^2$ containing 25% low surface area calcium carbonate and 1% of the ethyl vanillin treated carbon as prepared above. The handsheets were dried duplicating paper machine drying conditions and treated with a 2.0% solution of potassium citrate and redried again duplicating paper machine drying conditions. The resulting paper had a blue-white color and was cut into 27.5 mm×65 mm strips. Filtered king-size cigarettes (20 mm filter, 65 mm tobacco column) were prepared, using the handsheet cigarette paper, prepared as described above, as the cigarette wrapper. On smoking of the cigarette containing the ethyl vanillin treated carbon wrapper, a definite aroma of ethyl vanillin was observed in the sidestream smoke, and a pleasant vanillin taste was present in the mainstream smoke. Appearance of the cigarette was totally acceptable, having a normal grayish cast caused by the tobacco show-through of the paper.

EXAMPLE II

To 10 grams of GX 250 activated carbon from North American Carbon, Inc., was added 0.050 grams of 3 methyl pentanoic acid. The treated carbon was well mixed and allowed to stand overnight. Reduced sidestream smoke cigarette paper handsheets were then prepared having the following properties: Basis weight of 45 gm/M$^2$ containing 10% magnesium hydroxide prepared, as described in U.S. Pat. No. 4,915,118, 30% Ecusta low surface area calcium carbonate and 0.5% of the above-treated carbon. The handsheets were dried, as in Example I, and then treated with a 6.5% solution of potassium citrate and 1% sulfuric acid and redried. The potassium citrate and 1% sulfuric acid and redried. The resulting paper had a blue-white to very light gray color and was cut into 27.5 mm×65 mm strips. Filtered king-size cigarettes (20 mm filter, 65 mm tobacco column) were prepared, using the handsheet reduced sidestream smoke cigarette paper, as described above, as the cigarette wrapper. On smoking of the cigarette containing the 3 methyl pentanoic acid treated carbon wrapper, a definite enhancement of tobacco taste was noted in the mainstream taste, and an enhancement of the tobacco aroma was noted in the sidestream smoke. Appearance of the cigarette was totally acceptable.

TABLE 1

| | | | | FLAVORANT TREATED CARBON | | | | | |
|---|---|---|---|---|---|---|---|---|---|
| Flavorant | Weight gm/M$^2$ | Type Carbon | % Carbon in Paper | % Carbon Treatment | Per. Cig. (Mg) | Per M$^2$**** | Comments | Paper Color | Cigarette Appearance |
| Ethyl Vanillin[(a)] | 25 | GX248[1] | 1.0 | 25 | 0.11 | 62.5 | Good EV taste/odor | Blue white | Acceptable |
| Ethyl Vanillin | 25 | GX248 | 2.0 | 25 | 0.22 | 125.0 | Strong EV taste/odor | Light Gray | Acceptable |
| Ethyl Vanillin | 25 | GX248 | 0.5 | 25 | 0.06 | 31.3 | Low/detectable EV | Light blue white | Acceptable |
| Ethyl Vanillin | 45 | GX248 | 1.0 | 25 | 0.20 | 112.5 | Strong EV taste/odor | Very light gray | Acceptable |
| Ethyl Vanillin | 45 | GX248 | 0.5 | 25 | 0.10 | 56.3 | Good EV taste/odor | Blue white | Accceptable |
| Ethyl Vanillin | 45 | GX248 | 0.25 | 25 | 0.05 | 28.1 | Low/detectable EV | Light blue white | Acceptable |
| Ethyl Vanillin | 45 | GX248 | 1.0 | 12.5 | 0.10 | 56.3 | Good EV taste/odor | Very light gray | Acceptable |
| Ethyl Vanillin | 45 | GX250[2] | 1.8 | 12.5 | 0.10 | 56.3 | Good EV taste/odor | Very light gray | Acceptable |
| Ethyl Vanillin | 45 | GX250 | 2.0 | 12.5 | 0.20 | 112.5 | Strong EV taste/odor | Light gray | Unacceptable |
| Ethyl Vanillin | 45 | GX186[3] | 1.0 | 12.5 | 0.10 | 56.3 | Very low EV taste/odor | Black specks | Unacceptable |
| Ethyl Vanillin | 45 | P100[4] | 1.0 | 12.5 | 0.10 | 56.3 | Good EV taste/odor | Very small black specks | Unacceptable |
| Ethyl Vanillin | 45 | GX224[5] | 1.0 | 12.5 | 0.10 | 56.3 | Very low EV taste/odor | Small black specks | Unacceptable |
| 3 MPA* | 45 | GX250 | 1.0 | 2.5 | 0.02 | 11.3 | Too strong, slightly bitter | Very light gray | Acceptable |
| 3 MPA | 45 | GX250 | 0.5 | 0.50 | 0.002 | 1.1 | Good enhanced tobacco taste | Very light gray | Acceptable |
| 3 MPA | 45 | GX250 | 1.0 | 0.25 | 0.002 | 1.1 | Good enhanced tobacco taste | Very light gray | Acceptable |
| 3 MPA | 45 | GX250 | 1.0 | 0.15 | 0.0012 | 0.7 | Low enhanced tobacco taste | Very light gray | Acceptable |
| 3 MPA | 45 | GX250 | 1.0 | 0.05 | 0.0004 | 0.2 | Minimal taste change | Very light gray | Acceptable |
| 3 MPA | 45 | GX250 | 1.0 | 0.50 | 0.004 | 2.3 | Strong enhanced tobacco taste | Very light gray | Acceptable |
| 3 MPA | 45 | GX250 | 1.0 | 2.0 | 0.016 | 9.0 | Too strong, slightly bitter | Very light gray | Acceptable |
| 3 MPA | 25 | GX250 | 1.0 | 0.5 | 0.002 | 1.3 | Good enhanced tobacco taste | Blue white | Acceptable |
| Chocolate** | 45 | GX250 | 1.0 | 10 | 0.08 | 45.0 | Good chocolate taste/aroma | Very light gray | Acceptable |

TABLE 1-continued

| Flavorant | Weight gm/M² | Type Carbon | % Carbon in Paper | % Carbon Treatment | Per. Cig. (Mg) | Per M²**** | Comments | Paper Color | Cigarette Appearance |
|---|---|---|---|---|---|---|---|---|---|
| | | | | FLAVORANT TREATED CARBON | | | | | |
| IA-IV*** | 45 | GX250 | 1.0 | 10 | 0.08 | 45.0 | Fruity aroma/taste | Very light gray | Acceptable |

(a)Applied to carbon from a 50% ethyl alcohol solution
*3MPA = 3 Methyl pentanoic acid
**Chocolate = Firmenich Chocolate Flavor 587.593
***IA-IV = Isoamyl Isovalerate (Aldrich W20850-7)
****Cigarette Paper dimensions = 27.5 mm × 65 mm
[1]GX248 Wood-based activated carbon from:
North American Carbon, Inc.
432 McCormick Boulevard
Columbus, Ohio 43213-1585
Particle Size ASTM E-11 = Greater than 98% thru 325 mesh
$CCl_4$ activity - 110% minimum
[2]GX250 Wood-based activated carbon from:
North American Carbon, Inc.
432 McCormick Boulevard
Columbus, Ohio 43213-1585
Particle size ASTM E-11 = Greater than 99% thru 325 mesh
$CCl_4$ activity - 110% minimum
[3]GX186 Coconut shell-based activated carbon from:
North American Carbon, Inc.
432 McCormick Boulevard
Columbus, Ohio 43213-1585
Particle size ASTM E-11 = 2.2% on 50 mesh
88.2% on 140 mesh
9.6% thru 140 mesh
$CCl_4$ activity - 60% minimum
[4]P100 Wood-based activated carbon from:
North American Carbon, Inc.
432 McCormick Boulevard
Columbus, Ohio 43213-1585
Particle size ASTM E-11 = 8.4% on 200 mesh
26.5% on 325 mesh
73.5% thru 325 mesh
$CCl_4$ activity - 110% minimum
[5]GX224 Coconut shell-based activated carbon from:
North American Carbon, Inc.
432 McCormick Boulevard
Columbus, Ohio 43213-1585
Particle size ASTM E-11 = 10.1% on 80 mesh
66.8% on 325 mesh
23.1% thru 325 mesh
$CCl_4$ activity - 60% minimum

I claim:

1. A wrapper for smoking articles, comprising a cellulosic fiber sheet containing a small amount, but less than about 2%, of activated carbon having absorbed onto the carbon a volatile flavorant.

2. The wrapper, as defined in claim 1 wherein the carbon content is from about 0.1% to about 1.0%.

3. The wrapper, as defined in claim 2, wherein the volatile flavorant is selected from the group consisting of vanillin, ethyl vanillin, 3 methyl pentanoic acid, ethyl valerate and isoamyl isovalerate.

4. The wrapper, as defined in claim 2, wherein the volatile flavorant volatilizes from the carbon at temperatures between about 50° C. and 300° C.

5. The wrapper, as defined in claim 4, further including 0.0% to 10% mono-, di-, tri-, or poly-saccharides.

6. A smoking article comprising a tobacco charge, such as cigarettes, cigars, and the like, and a wrapper comprising a cellulosic fiber sheet containing a small amount, but less than about 2% of activated carbon having absorbed onto the carbon a volatile flavorant.

7. The smoking article, as defined in claim 6, wherein the carbon content is from about 0.1% to about 1.0%.

8. The smoking article, as defined in claim 7, wherein the volatile flavorant is selected from the group consisting of vanillin, ethyl vanillin, 3 methyl pentanoic acid, ethyl valerate and isoamyl isovalerate.

9. The smoking article, as defined in claim 7, wherein the volatile flavorant volatilizes from the carbon at temperatures between about 50° C. and 300° C.

10. The smoking article, as defined in claim 9, further including 0.0% to 10% mono-, di-, tri-, or poly-saccharides.

11. A method for improving the taste and aroma subjectives of a smoking article comprising wrapping a tobacco charge in a combustible cellulosic sheet containing a small amount, but less than about 2%, of activated carbon having absorbed onto the carbon a volatile flavorant.

12. The method defined in claim 11, wherein the carbon content is from about 0.1% to about 1.0%.

13. The method, as defined in claim 12, wherein the volatile flavorant is selected from the group consisting of vanillin, ethyl vanillin, 3 methyl pentanoic acid, ethyl valerate and isoamyl isovalerate.

14. The method, as defined in claim 13, wherein the volatile flavorant volatilizes from the carbon at temperatures between about 50° C. and 300° C.

15. The method, as defined in claim 14, further including 0.0% to 10% mono-, di-, tri-, or poly-saccharides.

* * * * *